United States Patent [19]

Schweiso

[11] 4,095,299

[45] Jun. 20, 1978

[54] LABEL AND METHOD FOR DETERMINING MATTRESS ROTATION

[76] Inventor: Robert J. Schweiso, 1028 Edmonds Ct., Sunnyvale, Calif. 94087

[21] Appl. No.: 699,390

[22] Filed: Jun. 24, 1976

[51] Int. Cl.[2] ..... A63F 9/00; A63H 33/16

[52] U.S. Cl. ..... 5/317 R; 5/92; 2/80; D6/201; 5/323

[58] Field of Search ..... 5/92, 312, 317 R, 322, 5/323, 345 R; 283/18–21; 35/11; 40/2 R; 2/80, 243 B; 46/1 L; 273/1 R; D6/201

[56] References Cited

U.S. PATENT DOCUMENTS

| | | | |
|---|---|---|---|
| 1,419,634 | 6/1922 | Koewing | 2/243 B |
| 2,445,030 | 7/1948 | Mandelbaum | 5/323 |
| 2,651,862 | 9/1953 | Fine | 283/21 |
| 2,849,729 | 9/1958 | Goodey, Jr. et al. | 5/2 |
| 3,258,858 | 7/1966 | Cariffe, Jr. | 2/80 X |
| 3,376,585 | 4/1968 | Muzaurieta | 5/345 R |
| 3,775,775 | 12/1973 | Mazzenga | 2/80 |
| 3,878,638 | 4/1975 | Benjamin | 46/1 L |
| 4,009,880 | 3/1977 | Lammersen | 273/1 R |

*Primary Examiner*—Casmir A. Nunberg
*Attorney, Agent, or Firm*—Warren M. Becker

[57] ABSTRACT

A label or message instructing that the mattress be turned over from left to right is affixed to the upper surface of the mattress or is provided thereon by means of printing, stencilling, sewing or weaving or by any other convenient means. A second label or message is similarly provided on the underside of the mattress for instructing that the mattress be turned over from head to foot. When the mattress is to be rotated, it will only be necessary to read the instruction label on the exposed surface, which will indicate which of the alternate turning operations is to be performed. Instead of using two labels, a single label or message can be provided on a vertical surface of the mattress, such label or message bearing two instructions in inverted relation to one another, the first instructing that the mattress be turned over from left to right, the second instructing that the mattress be turned over from head to foot.

6 Claims, 10 Drawing Figures

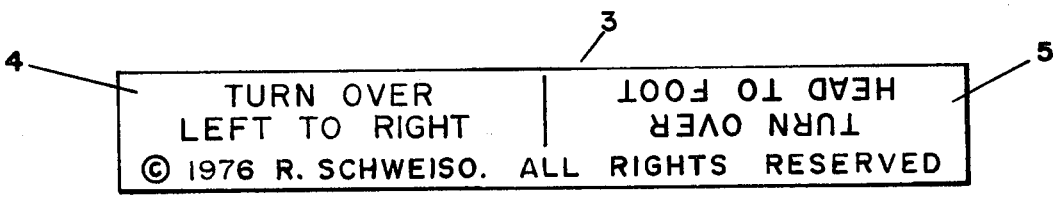

FIGURE 3

1

TURN OVER
LEFT TO RIGHT
© 1976 R. SCHWEISO.
ALL RIGHTS RESERVED

FIGURE 1

2

TURN OVER
HEAD TO FOOT
© 1976 R. SCHWEISO.
ALL RIGHTS RESERVED

FIGURE 2

3 4 5

TURN OVER
LEFT TO RIGHT
HEAD TO FOOT
TURN OVER
© 1976 R. SCHWEISO. ALL RIGHTS RESERVED

FIGURE 3

6

TURN OVER
HEAD TO FOOT
© 1976 R. SCHWEISO.
ALL RIGHTS RESERVED

FIGURE 4

7 8 9

TURN OVER
HEAD TO FOOT
HEAD TO FOOT
TURN OVER
© 1976 R. SCHWEISO. ALL RIGHTS RESERVED

FIGURE 5

10

TWO STEP ROTATION
FIRST: SLIDE AROUND
HEAD TO FOOT
SECOND: TURN OVER
LEFT TO RIGHT
© 1976 R. SCHWEISO.
ALL RIGHTS RESERVED

FIGURE 6

11 12 13

TWO STEP ROTATION
FIRST: SLIDE AROUND
HEAD TO FOOT
SECOND: TURN OVER
LEFT TO RIGHT
TWO STEP ROTATION
FIRST: SLIDE AROUND
HEAD TO FOOT
SECOND: TURN OVER
LEFT TO RIGHT
© 1976 R. SCHWEISO. ALL RIGHTS RESERVED

FIGURE 7

14

TWO STEP ROTATION
FIRST: SLIDE AROUND
HEAD TO FOOT
SECOND: TURN OVER
LEFT TO RIGHT
© 1976 R. SCHWEISO.
ALL RIGHTS RESERVED

FIGURE 8

15

ONE STEP ONLY
TURN OVER
LEFT TO RIGHT
© 1976 R. SCHWEISO.
ALL RIGHTS RESERVED

FIGURE 9

17 16 18

TWO STEP ROTATION
FIRST: SLIDE AROUND
HEAD TO FOOT
SECOND: TURN OVER
LEFT TO RIGHT
ONE STEP ONLY
TURN OVER
LEFT TO RIGHT
© 1976 R. SCHWEISO. ALL RIGHTS RESERVED

FIGURE 10

LABEL AND METHOD FOR DETERMINING MATTRESS ROTATION

BACKGROUND OF THE INVENTION

This invention relates to the periodic rotation of mattresses and a label and method for determining the next step in the optimum sequence of rotation.

It is generally accepted that periodic rotation of mattresses will prolong their life and improve the comfort they provide. Rotation should ensure that the most recently used (upper) surface is alternated with the relatively restored under-surface. Of secondary importance is the fact that the right side should be exchanged for the left side, and the head exchanged for the foot. These exchanges should be made in alternation with each other. Thus the optimum sequence is to turn the mattress over left to right on the first rotation and then head to foot on the next rotation, and so on. It should be noted that exchange of one side for the other is achieved whether the mattress is turned over left to right or right to left. This consideration also applies in regard to head to foot rotation.

Heretofore, the optimum sequence of rotation has been seldom achieved, mostly because of the difficulty on the part of a mattress owner remembering which step in the rotation sequence should be made.

One problem in optimizing rotation is the absence of any indication on the mattress to indicate how the rotation should be made. In some cases, mattresses bear labels, such as THIS SIDE UP, which would discourage any turning over of the mattress, whereas in other instances only rotation within the plane of the mattress is indicated. There are no mattress labels, or any other means, which aid the mattress owner in remembering which way the mattress was rotated the last time. Furthermore, none of the labels presently used on mattresses enable the mattress owner to alternately rotate his mattress in the optimum sequence.

SUMMARY OF THE INVENTION

In accordance with this invention, a label comprising visible instruction means is affixed to the mattress so that, by following the instruction, the mattress will be periodically rotated in the optimum alternate directions without any requirement for knowledge of the previous rotation. Preferably, labels can be affixed or the information can be stencilled, printed, sewn or woven into the mattress on the top and bottom thereof, one label instructing that the mattress be turned from left to right, the other label instructing that it be turned from head to foot. Alternatively, a single label, bearing the two instructions in inverted relationship with each other, can be affixed to a vertical surface of the mattress. If so desired, more than one label can be used.

According to the method of this invention, mattresses having the instructional labels described above are turned over from left to right on one occasion and are turned over from head to foot on the next, such turning operations being alternated at set intervals and in accordance with the instructions on the label.

It is a particular object of this invention to provide a label and method for mattress rotation that will ensure an exchange of the upper and lower surfaces of the mattress.

It is another object of this invention to provide a label and method to ensure that a mattress will be turned over from left to right and, alternately, from heat to foot.

It is another object of this invention to provide an instructional label for rotating mattresses that can be affixed to the upper and under surfaces or to a vertical surface of the mattress.

A DESCRIPTION OF THE DRAWINGS

The above and other objects, features and advantages of the present invention will be apparent from the detailed description of the invention and the accompanying drawings in which:

FIG. 1 shows a label to be affixed to the upper surface of a mattress.

FIG. 2 shows a companion label of FIG. 1, to be affixed to the lower surface of a mattress.

FIG. 3 shows a label to be affixed to at least one vertical surface of a mattress.

FIG. 4 shows a label to be affixed to both the upper and lower surfaces of a mattress.

FIG. 5 shows a label to be affixed to at least one vertical surface of a mattress.

FIG. 6 shows a label to be affixed to the upper and lower surfaces of a mattress.

FIG. 7 shows a label to be affixed to at least one vertical surface of a mattress.

FIG. 8 shows a label to be affixed to the upper surface of a mattress.

FIG. 9 shows the companion label of FIG. 8 to be affixed to the lower surface.

FIG. 10 shows a label to be affixed to at least one vertical surface.

DESCRIPTION OF PREFERRED EMBODIMENTS

Referring to the drawings, FIG. 1 shows a label 1 to be affixed to the upper surface of a mattress and bearing the instruction that the mattress is to be turned over from left to right. Another label 2, shown in FIG. 2, is to be affixed to the underside of the same mattress. The mattress is rotated on one occasion per the instruction of label 1, and on the next occasion is rotated per the instruction of label 2. Accordingly, each rotation will result in the mattress being turned over, with an alternate turning direction being instructed each time. The mattress owner need not remember which way the mattress was turned the last time, since the labels will "remember" for him. Thus, the optimum rotation will be ensured at the periodic rotating of the mattress.

FIG. 3 shows a single label 3 bearing two instructions 4, 5 which are in inverted relationship with one another. Label 3 is affixed to at least one vertical surface of a mattress. Accordingly, label 3 provides the same rotation instructions as do the labels of FIGS. 1 and 2, with the same beneficial results. It is completely self-programming, in that only one label affixed to a vertical surface of the mattress will suffice to describe the optimum rotational sequence and can identify at any time which rotation is to be made next regardless of its location on the surface.

FIG. 4 shows a label 6 to be affixed to the upper and lower surfaces of a mattress, for mattresses used in hotels, hospitals and the like which have transient traffic and hence to not require left to right rotation to the same extent as do residential type mattresses. That is, with transient beds the bearing loads will change from night to night, effecting load distribution without the need for left to right rotation. Thus, label 6 directs only limited, head to foot rotation. Since the rotation here is always the same, label 6 will not be quite as useful as the above labels, but its presence will have two benefits: it will remind personnel that the mattress should be rotated, and it will instruct a novice as to the desired manner of rotation.

FIG. 5 shows a label 7, with two instructions 8, 9 in inverted relationship, which is to be affixed to a vertical surface of a mattress for accomplishing the same rotation as the label of FIG. 4.

FIGS. 6 and 7 show labels 10, 11, the later bearing instructions 12, 13 in inverted relationship with each other, for use where it is inconvenient or virtually impossible to turn a mattress over head to foot, such as with bunk beds. Label 10 is to be affixed to the upper and lower surfaces of a mattress; label 11 is to be affixed to a vertical surface of a mattress. Thus, to achieve the desired rotation, the mattress is to be slid around 180° and then turned over from left to right. Since this is a more complex procedure than simply turning the mattress over from head to foot, the need for an instructive label is significantly greater. The use of a label, especially one listing the dates for rotation, would add assurance that both steps of the procedure were being followed, even by novices.

Labels 14, 15 and 16, shown in FIGS. 8, 9 and 10, serve essentially the same purpose as labels 1, 2 and 3. The only difference is that the latter three labels provide for the more convenient two-step head to foot rotation described above in reference to labels 10 and 11. Label 15 and instruction 18 are added, however, to provide for alternate left to right rotation. Label 14 is affixed to the upper surface of a mattress, with label 15 being affixed to the lower surface. Label 16, bearing the two-step instruction in inverted relationship, is affixed to a vertical surface of a mattress. Labels 14, 15, 16 thus provide instructions for not only the head to foot turning described by labels 10, 11, but also for left to right turning, thereby assuring the most beneficial mattress rotation.

A preferred feature of the labels of this invention would be a convenient form of dating, such as monthly, quarterly, etc. In usage, the two labels or label halves would indicate alternating months or desired rotation dates. It could then be checked, by examination of the label, whether the mattress had been rotated per schedule.

All of the above labels can be printed on, stencilled or sewn into the fabric of a mattress, or otherwise affixed thereto.

It is thus apparent that a new and useful label and method for determining mattress rotation has been provided.

The embodiments as described above are only examples of the invention, and other modifications may be made by one skilled in the art without departing from the spirit thereof, as set forth in the following claims.

What is claimed is:

1. A label or a pair of labels for a mattress which, when located on a predetermined part of the mattress, comprises a first instruction which is readable when the mattress is in a first position for directing the reader thereof to move the mattress from the first position to a second position and which is readable when the mattress in in a third position for directing the reader thereof to move the mattress from the third position to a fourth position; and a second instruction which is readable when the mattress is in the second position for directing the reader thereof to move the mattress from the second position to the third position and which is readable when the mattress is in the fourth position for directing the reader thereof to move the mattress from the fourth position to the first position whereby the mattress can be rotated in a predetermined sequence by one or more persons without any one of the persons having to have knowledge of or recall the nature of the immediate past movement of the mattress.

2. The label of claim 1 wherein the instructions are stencilled on, printed on, or woven into the fabric of the mattress.

3. The label of claim 1 wherein the first instruction is affixed to the upper surface of the mattress, the other is affixed to the lower surface thereof, with the first instructing that the mattress is to be turned over from left to right, and the second instructing that the mattress is to be turned over from head to foot.

4. The label of claim 3 wherein the instruction affixed to the upper surface instructs that the mattress be slid around head to foot and turned over left to right, and wherein the second instruction instructs that the mattress be turned over only from left to right.

5. The label of claim 1 wherein the first and second instructions are affixed to at least one vertical mattress surface, in inverted relationship to each other, the first instructing that the mattress be turned over from left to right, the second instructing that the mattress be turned over from head to foot.

6. The label of claim 5 wherein the first instruction instructs that the mattress be slid around head to foot and turned over left to right, and wherein the second instruction instructs that the mattress be turned over only from left to right.

* * * * *